United States Patent [19]

Callhan

[11] Patent Number: 4,737,049

[45] Date of Patent: Apr. 12, 1988

[54] ROADWAY REFLECTOR DEVICE

[76] Inventor: Edward J. Callhan, 54 Norfolk St., Canton, Mass. 02021

[21] Appl. No.: 946,886

[22] Filed: Dec. 29, 1986

[51] Int. Cl.[4] ..... E01F 9/06

[52] U.S. Cl. ..... 404/11; 404/14; 350/99; 350/104; 116/63 R

[58] Field of Search ..... 404/9–12, 404/14–16; 350/97, 99, 102–109; 116/63 R

[56] References Cited

U.S. PATENT DOCUMENTS

| | | | |
|---|---|---|---|
| 1,825,667 | 10/1931 | Johnson | 404/11 |
| 2,157,059 | 5/1939 | Rosener | 404/11 |
| 3,374,763 | 3/1968 | Browning | 350/99 X |
| 3,920,348 | 11/1975 | Paulos | 404/11 X |
| 4,188,150 | 2/1980 | Sroka | 404/11 |
| 4,234,264 | 11/1980 | Baldi | 404/11 |

FOREIGN PATENT DOCUMENTS

| | | | |
|---|---|---|---|
| 216369 | 7/1958 | Australia | 404/11 |
| 614657 | 12/1948 | United Kingdom | 404/11 |

*Primary Examiner*—Stephen J. Novosad
*Assistant Examiner*—John F. Letchford
*Attorney, Agent, or Firm*—Herbert L. Gatewood

[57] ABSTRACT

A roadway reflector device to be embedded in a roadway but with the reflector element thereof projecting partly above the roadway surface, to be seen by oncoming motorists and used as a guide. The reflector element is elongated and of circular shape, in cross-section. When the reflector element, located in a roadway so that its lengthwise direction lies in a direction transverse to the direction of travel, is impacted by a horizontally directed force, that force causes the reflector element to rotate, and when impacted by a vertically downward force is pushed downwardly into the housing for the device against a compressible means, which on removal of the downwardly directed force returns to its original vertical location. Thus, the potentially damaging effects of these impacting forces is nullified, leaving the reflective device undamaged.

44 Claims, 5 Drawing Sheets

ROADWAY REFLECTOR DEVICE

BACKGROUND OF THE INVENTION

1. Field of the Invention

This invention relates, in general, to a roadway reflector device for marking the lanes of a roadway or for use in constructing directional aids. More particularly, it relates to such a device which is substantially embedded below the grade of the roadway so as not to be damaged by, or to interfere with the movement of, oncoming traffic which passes over or upon the reflector device. Even more particularly, the invention relates to a roadway reflector device which gives way not only to a force directed downwardly on it but one also directed against it from the horizontal.

2. Description of the Prior Art

Roadway lane markers of the type that are embedded in the roadway and which, at least partially, project above the roadway surface, to indicate a traffic lane to a driver at night time, have been known now and, in some cases, used, for quite sometime. Such lane markers are more desirable than the usual painted dividing lines, not only because these markers, particularly if also reflective, are more visible to a driver over a greater distance than the usual white or yellow painted traffic lines but also because these devices, particularly those that are reflective, will function better in many instances where painted traffic lines are seen by a driver only with difficulty, or not at all, for example, as on wet roadways, or in cases of fog, or a newly snowplowed road, or in the light glare from oncoming vehicles. Nevertheless, though preferred to painted lane markers, the embedded reflective lane markers known about, and used heretofore, have not been without certain disadvantages.

One embedded lane marker used heretofore is shaped somewhat like a mushroom, the stem of that reflector device being located below the roadway surface with the reflective button on top thereof being mounted essentially at the surface of the roadway, to be visible to oncoming traffic. In some cases with such a lane marker device, the stem is capable of vertical up and down movement. Thus, when the tire of an oncoming vehicle passes over it, the marker is caused to move downwardly and offers little or no resistance to the impacting force, which resistance could result in damage to it. Nevertheless, in areas where the weather is cold, snow or ice sometimes packs around the stem, making it immovable against the force of impact and often resulting in a damaged reflector.

Although snow and ice packing around the stem of the just described lane marker device is a major problem source, another problem with such a device is that road debris, e.g., sand, and dirt, compacts around the stem, interfering with the device's ability to reciprocate vertically up and down. Thus, in that case, the so immobilized device offers resistance to an impacting force of a vehicle tire passing thereover and is, consequently, subjected to continuing damage.

The major shortcoming, however, of such a prior used lane marker device, at least in certain geographical areas, is the fact that it is capable only of vertical up and down movement. Thus, it gives way to a force exerted vertically downwardly on it, such as in the case of a vehicle tire passing over it. Nevertheless, it does not give way to a horizontally directed force, i.e., one directed at the reflector device from the side rather than essentially from the top. As a result, when the edge of the reflector button is hit just right by, for example, the blade of a snowplow, the lane marker device is damaged. In some cases, moreover, the reflective top is cut right off from the stem, or the entire device is ripped out of the roadbed.

When an embedded reflector device is damaged, or worse yet is ripped out of the roadway, there may be nothing then for some distance, to guide an oncoming motorist, leading to unsafe traffic conditions. This is a particular problem where two or more lane markers in a row are damaged, or missing. Thus, because of the damage caused to embedded lane marker devices, as abovedescribed, and the potential for such damage, from snowplows and the like which contact the device with a horizontally directed, impacting force, there has existed a continuing search over the years, for a better, and more enduring, roadway reflector device.

In U.S. Pat. No. 4,188,150, there is disclosed a lane marker of the embedded type which, contrary to the device described just above, and according to the patentee, is capable of giving way not only to a force directed vertically downwardly but also one horizontally from the side. In that device, a spherical member, or ball, mounted in a housing so as to project only partly above the roadway surface, is capable not only of rotational, but vertical up and down movement, as well. Thus, as claimed by the patentee, when a snowplow blade strikes the spherical member with an oncoming horizontally directed force, an upwardly directed vector of that force will cause the spherical member to rotate and a downwardly directed vector will push it downwardly against a spring. As a result, as can be inferred from the disclosure in that patent, as long as the spherical member is, and remains, freely rotatable, there should be no damage done by a snowplow to the lane marker, or at least less damage than in the case of the relatively inflexible reflective button device.

Nevertheless, a disadvantage in the lane marker device disclosed in U.S. Pat. No. 4,188,150, results from the fact that its freedom to freely rotate depends entirely upon the initial and continued frictional characteristics of the rotatable, spherical member, relative to the seat therefor. These relative frictional characteristics can be affected considerably and disadvantageously in use, as in the case of the first previously disclosed, earlier used reflector device, due not only to snow and ice but, in particular, to sand, dirt, and other debris coming between the rotatable spherical member and its seat. In the worst case, the spherical member will no longer rotate and like the reflective button, as in the device earlier disclosed, when hit by a snow plow blade edge, because of its inability to rotate, can become damaged.

Furthermore, it is not clear from the disclosure in U.S. Pat. No. 4,188,150, whether the ball is of a plastic composition which contains colored materials such as a phosphorescent, which imparts to the ball its orange color, or the surface of the ball is merely colored with such a material. Nevertheless, the ball does not appear to have reflective characteristics.

Another lane marker of the type in which a rotatable spherical element is provided, located in a socket therefor, and which projects in part above the roadway surface, is disclosed in U.S. Pat. No. 4,234,264. In that device, however, the rotatable spherical element rather than being capable of vertical up and down movement, as well as being rotatable, is deformable, instead. Thus, according to the patentee, when impacted by a force, the impacting force is nullified, as that force causes the sphere to be initially deformed and, if the impacting force is excessive, the sphere then is caused by that force to rotate in its supporting socket. The sphere disclosed in U.S. Pat. No. 4,234,264 is hollow, and transparent, and includes, within it a reflective body which floats in a fluid. The reflective body has in the bottom thereof a magnet attractable by another magnet located at the bottom of the socket for the rotatable sphere.

Normally, the attraction of the magnets for one another causes the flotable reflective member to maintain the reflective portion thereof in an upright position whereby to be picked up by the lights of vehicles of oncoming motorists, and reflected back. When a force impacts the spherical member, e.g., the tire of a moving automobile, it deforms, and the force attracting the two magnets together is overcome at the same time. Thus, this lane marker, in accordance with what can be inferred from the patent, gives way to any potentially damaging force, whatever it may be, whether directed downwardly or from the side. When the impacting force passes by the lane marker, according to the patentee, the hollow, temporarily deformed sphere resumes its spherical shape, as a result of the reflective member realigning itself due to the attraction of the magnets one for the other. The spherical member is mounted to snugly fit in the socket therefor, whereby, according to the patentee, to prevent liquid or any foreign matter from affecting its operation. Nevertheless, this lane marking device, like that in U.S. Pat. No. 4,188,150, depends for its continued good operation substantially on the free rotation of the spherical member in its socket and that free rotation depends, in turn, upon the frictional characteristics of the sphere relative to the socket. It also depends for continued good functioning on the integrity of the material of the deformable spherical member, when subjected to great force of impact by, e.g., the edge of a snowplow blade.

SUMMARY OF THE INVENTION

There is provided, in accordance with the general aspects of this invention, a roadway reflector device not subject to the problems just above-described. Thus, dirt and debris does not collect in the device whereby to adversely affect its proper functioning. And, neither can snow compact around it, or water collect therearound, and in, so as to reduce its operability, possibly resulting in damage from impacting forces.

Most importantly, however, in accordance with the basic aspects of the invention, the exposed portion of the reflector element of the roadway reflector device of this invention, when impacted by a horizontally directed force such as that of the edge of a snowplow blade, is caused to rotate and, when impacted by a vertically downward force such as that of a vehicle tire passing thereover is pushed downwardly into the housing for the reflector device, against a compressible force. In either event, however, the potentially damaging effects of these impacting forces are, quite advantageously, nullified by the operation of the reflector device of this invention.

The reflector element in the device of this invention is of unique construction, offering not only good reflecting characteristics but, at the same time, a device less subject to damage from impacting forces than found in roadway reflector devices known and used hereto. A unique advantage of the roadway reflector device of this invention is that only a relatively small portion thereof, and then only the reflector element, is exposed above the roadway surface whereby to be subjected to possibly damaging impacting forces. Thus, there is provided, in accordance with the basic aspects of the invention:

A roadway reflector device suitable for marking the lanes in a roadway and which is to be embedded substantially below the grade of that roadway yet having a portion thereof projecting above the grade to be seen by oncoming motorists comprising:

(a) a reflector assembly capable of vertical up and down movement comprising:
  (1) an elongated, circular-shaped, horizontally disposed, rotatable reflector element;
  (2) a member for supporting that reflector element in a freely rotatable manner and in said horizontally disposed position comprising planar, parallel, horizontally disposed top and bottom surfaces defining the extremities of said supporting member vertically, and an elongated well in said top surface for location of said elongated rotatable reflector element;

(b) a housing for reciprocally supporting the said reflector assembly in vertical up and down manner having an open top and being defined by a planar horizontally disposed bottom member having a top surface and a bottom surface; and (c) compressible means located between said bottom surface of the said supporting member for the reflector element and the said top surface of the bottom member of said housing for reciprocally supporting the said reflector assembly.

The rotatable elongated reflector element, quite advantageously, can be of various unique constructions, each providing quite good reflecting characteristics. In one embodiment, according to the invention, the reflector element comprises a plurality of teeth extending in the lengthwise direction and located uniformly around the circumference of the circular-shaped reflector element in spaced-apart disposition. Thus, in crosssection the reflector element looks much like a gear wheel. In use, the sides of the teeth, being disposed laterally to the direction of travel are "seen" by the lights of the oncoming vehicle, and those lights are reflected backwardly and then seen by the motorist. It will be appreciated that, in this embodiment, that the reflector element can comprise various reflective material, in either its entirety, or just on the teeth. If desired, conventional reflective patterns can be provided on the teeth, inherent in the manufacture of the roadway reflector, or these can be separately manufactured in strips and adhesively attached to the teeth.

In a more preferred embodiment of the invention, the elongated reflector element is of a clear plastic composition and of cylindrical construction. The outside peripheral surface of the reflector element, as might be impacted by a snowplow blade, is smooth. The inside cylindrical surface, on the other hand, is provided with a reflective pattern. Thus, quite advantageously, the reflective pattern is not impacted at all by a potentially damaging snowplow blade or other object.

A further advantage with the cylindrical-shaped reflector element provided by this invention is that a reflective composition can be provided in the cavity, inherent in such a construction, rather than, or in addition to, the reflective pattern provided on the inside cylindrical-shaped surface, if desired.

Moreover, in a further unique embodiment of the roadway reflector device disclosed in this application, a solar collector can be located within the cavity in the cylindrical-shaped reflector element. Thus, the light collected during the day by the solar collector will be emitted therefrom at dusk, making the reflector device visible to an oncoming motorist prior to the time that a motorist's lights are turned on, and the device operates as a reflector.

BRIEF DESCRIPTION OF THE DRAWINGS

The novel features and operation of the roadway reflector device of the present invention will be better understood by reference to the drawing, in conjunction with reading the following specifications, in which.

DETAILED DESCRIPTION OF THE INVENTION AND THE PREFERRED EMBODIMENTS

Figure 1:
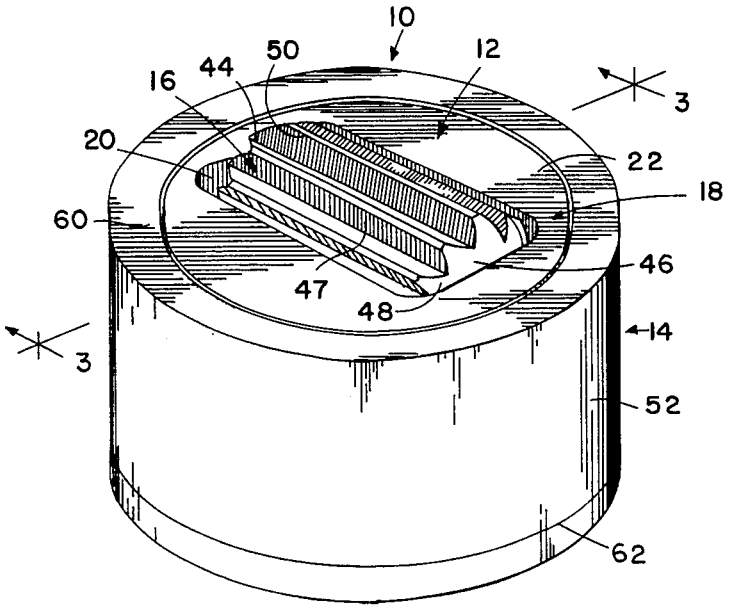
FIG. 1 is a view in perspective of a roadway reflector device, according to the invention.

Referring now to the drawing, there is disclosed in FIG. 1 thereof, in accordance with the invention, a roadway reflector device 10 comprising a reflector assembly 12, capable of vertical up and down movement, mounted in housing 14.

The reflector assembly 12 comprises an elongated, circular-shaped reflector element 16 mounted in, and supported by, support member 18, in an elongated well 20. As disclosed in the drawing, support member 18 comprises an elongated, vertically-disposed, circular-shaped, body member defined by planar, horizontally disposed, top and bottom surfaces 22, 24, parallel to one another, and upper and lower peripheral surfaces 26, 28, concentric to one another, and connected together by inwardly projecting, horizontally disposed, planar shoulder 30, the purpose for which will be later explained, if not already obvious from the drawings, in particular FIG. 3.

Figure 3:
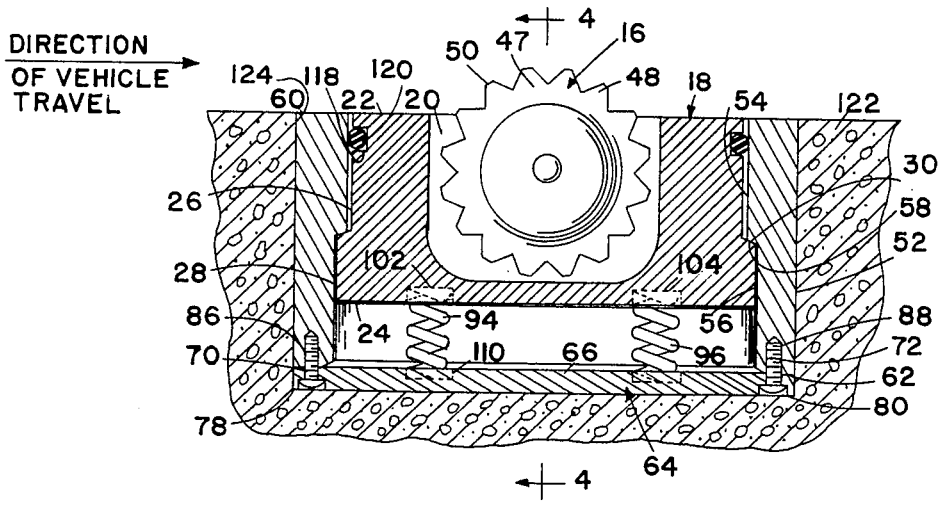
FIG. 3 is a view in cross-section, taken at secant lines 3—3 in FIG. 1, and showing the reflector device as mounted in a roadway.
Figure 4:
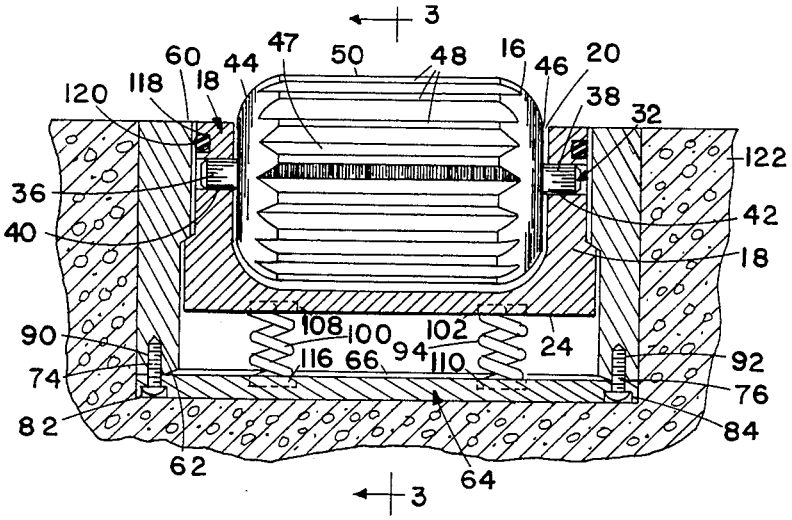
FIG. 4 is a sectional view of the reflector device shown in FIG. 1, transversely to that shown in FIG. 3.

The elongated well 20 projects inwardly from top surface 22 of the support member 18 and is essentially of rectangular cubic shape, to accommodate the location of the elongated, rotatable reflector element 16, with a portion thereof, importantly, projecting above the plane of top surface 22, as will be readily seen in FIG. 3 of the drawing. The reflector element is rotatably supported on, and by, an elongated, circular-shaped, pin or axle 32 which extends through elongated opening 34 located in the lengthwise direction of, and being centrally disposed in, reflector element 16. The diameter of opening 34 is slightly larger than that of pin 32 which in the practice of the invention, the reflector element 16 is freely rotatable thereon. As will be seen from FIG. 4, the length of pin 32 is such that its ends 36,38 extend outwardly from the ends of reflector element 16 equidistantly, and are located in respective circular-shaped openings 40,42, which are provided in opposition to one another, in the support member 18, at the ends of the well 20. The diameter of openings 40,42 is such as to provide a good frictional fit with the ends 36,38 of axle 32. Nevertheless, as will be appreciated by those skilled in the art, pin 32 can be stationary relative to reflector element 1 and turn in the supports, i.e., openings, 40,42, if desired. Or pin 32 can comprise two equal length sections with a spring member located between the two sections, and centrally disposed in elongated opening 34.

Reflector element 16, as earlier disclosed, is elongated and of a generally, circular shape in cross-section, and is defined by vertically disposed, planar ends 44,46, parallel to one another. As seen by reference to FIG. 4 , the ends 44,46 are rounded where connecting with the elongated, centrally disposed body member 47.

Figure 8:
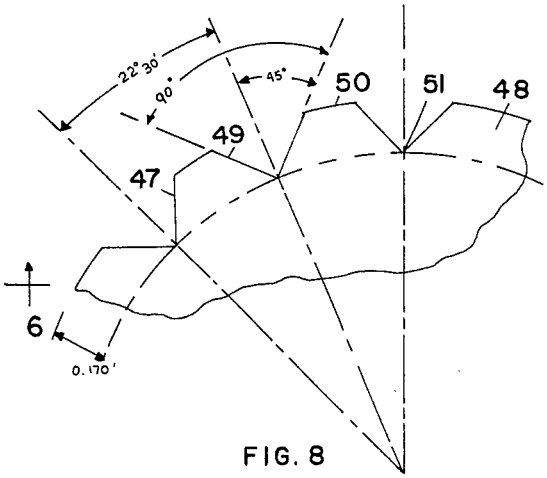
FIG. 8 is an enlarged end view showing a portion of the toothed reflector element in the reflector devices shown in FIGS. 1–7.

The peripheral surface of reflector element 16, i.e. of the centrally disposed elongated body member 47, is provided with a plurality of spaced-apart, elongated teeth 48, located uniformly about the circumference of the reflector element and extending in a lengthwise direction thereof. These teeth each terminate in a substantially flat surface 50, located equidistantly from the center of the elongated, circular-shaped body member comprising the reflector element 16. As will be more readily appreciated by reference to FIGS. 3,5, and 8, each tooth 48 is defined not only by the outer substantially flat surface 50, but is also defined by planar, elongated surfaces 47,49 (FIG. 8) which extend in lengthwise direction of the reflector element and diverge, or slant outwardly with respect to one another, in a direction inwardly, toward the reflector element body member. The number of teeth 48 provided can vary somewhat so long as the desired reflector characteristics are attained and will depend somewhat upon the diameter of the elongated circular-shaped element. Nevertheless, satisfactory results will be obtained in a reflector element approximately 2 inches in diameter in which the base thereof, as indicated in FIG. 8, subtends an angle of approximately 22° 30′, and has adjacent side surfaces 47,49 intersecting one another at a 90 degree angle, the height of the tooth measured inwardly on an imaginary radius of the reflector element body member and bisecting flat surface 50, being 0.170 inches. It will be appreciated that outer surface 50 may really be an arcuate surface, depending somewhat upon the method of manufacturer, but is essentially flat. The elongated reflector element 16 can vary somewhat in length, but one measuring 3 inches will be found satisfactory. In this case, the length of outer surface 50 can be approximately 2.5 inches, the trough 51 between next adjacent teeth 48, however, extending approximately the length of the reflector element between ends 44,46.

The reflector element 16 can be provided of various materials, as desired. Quite advantageously, however, it can be molded from various plastic compositions, according to conventional molding techniques. Nevertheless, it can be milled from a solid block of suitable plastic composition, if desired. Various conventional plastic materials can be used in manufacturing the reflector element, e.g., nylon, polyvinyl chloride, polyvinyl acetal resins, e.g. Delrin, polyethylene, etc. These materials can be compounded with various additives, as is conventionally done, to provide those properties desired in the reflector element. In particular, various conventional reflective materials known to those in the art can be compounded with the plastic composition, including reflective metals and retroreflective beads. Such materials may be dispersed throughout the reflector element, in which case the composition should be clear, i.e. transparent, or more concentrated at the outer extremities thereof and in the teeth 48, as desired. The reflector element composition can include coloring agents to provide a suitably colored reflector best for visibility, e.g., a white, yellow, or orange colored reflector element. These colors may be provided by materials that, in addition to color, provide iridescence, luminescence or phosphorescent properties, or such materials can be additionally included in the plastic composition.

Though somewhat less desired, the reflector element can be manufactured without any such materials included therein and these materials provided merely on the surface of teeth 48 as separately prepared compositions which are coated thereon. Strips of reflective material or of a reflective pattern, though less desired than where the reflective materials are dispersed in the plastic composition can also be adhesively secured to the surfaces of the teeth. Nevertheless, it will be appreciated that such external reflective materials will be subjected to impacting forces, and may be damaged, or displaced from the reflector element, making the reflector device, less effective, even if all the strips are not displaced, but only from certain teeth. Thus, the compounding of the reflective materials in the plastic composition to be molded provides a device with lasting good results, and is most preferred in this aspect of the practice of the invention.

Housing 14 comprises an annular-shaped upwardly extending body member having an outer circular-shaped surface 52 and an inner surface having an upper, circular-shaped surface 54 and a lower, circular shaped surface 56 of slightly larger diameter, the two surfaces being connected by an outwardly extending planar surface 58. When reflector assembly 12 is assembled with housing 14, surface 58 acts as a stop against further vertical, upward movement of the reflector assembly, as inwardly extending shoulder 30 comes into contact therewith. The location of the outwardly extending surface 58, relative to the lengthwise dimensions of housing 14 and reflector assembly 12, is such that, in its uppermost vertical location, the top surface 22 of the support member 18 lies in the same horizontal plane as does the upper, horizontally disposed, annular surface 60 of the upper body member of housing 14.

Figure 2:
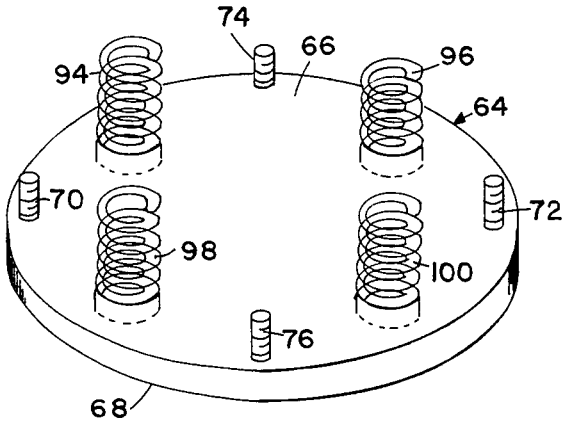
FIG. 2 is a view in perspective of the bottom plate of the housing of the reflector device shown in FIG. 1.

The bottom annular surface 62 of the upper body member of housing 14, which is parallel to annular surface 60, rests on, and is connected to, bottom member 64, a disc-shaped member, as shown in FIG. 2 of the drawing, defined by parallel top and bottom surfaces 66,68. The diameter of bottom member 64 and the outer diameter of the upwardly extending body member of housing 14 are the same, as is shown in FIGS. 1,3; however, this need not be the case, as will be appreciated by those skilled in the art. Nevertheless, a bottom member of larger diameter will necessarily require that a larger diameter hole be provided in the roadway and then filled in, adding further to the expense in installation, and accordingly, is less desired.

Bottom member 64 is detachably connected to the upper body member of the housing 14 at annular surface 62, this being accomplished by four conventional, elongated threaded members 70,72,74,and 76, which extend through circular-shaped holes 78,80,82,and 84, respectively, and into respectively located dead bores 86,88,90,and 92 extending vertically upwardly and inwardly from the annular surface 62.

As will be appreciated by reference to FIG. 3, the bottom surface 24 of the support member 18 is spaced upwardly a predetermined distance from top surface 66 of bottom member 64 and is reciprocally supported in that position by four, elongated coiled springs 94,96,98 (not shown),100, the upper and lower ends of which are located, respectively in dead bores 102,104,106 (not shown),108, in the bottom surface 24 of support member 18, and in dead bores 110,112,114 (not shown),116, in the top surface 66 of the bottom member 64. These dead bores, as will be appreciated, are in opposition to one another, when bottom member 64 is connected to the upper body member of the housing.

The support member 18 is provided with an annular groove 118, closely adjacent top surface 22 for location of a conventional O-ring 120 whereby water and road debris is prevented from entering into the device once installed. Thus, the reciprocal operation of the member 18 is not affected by inclement weather conditions.

The roadway reflector device 10 can be readily installed in a roadbed 122, this being accomplished by core drilling, according to conventional techniques, of a suitably sized dead bore 124 in the roadbed. The reflector device, most desirably, is press-fitted into dead bore 124; however, if desired, dead bore 124 can be any diameter desired and reflector device 10 centrally disposed therein, the excess space then being provided with any suitable back-fill material, e.g., an epoxy composition. In any event, the reflector device 10 should be installed in the roadbed 122 so that the top annular surface 60 is in the plane of the roadbed, as is top surface 22, leaving only a portion of the reflector element 16 projecting thereabove. The reflector device 10 should be installed in the roadbed 122 so that the elongated reflector element 18 is disposed in a direction, generally lateral, or perpendicular, to the direction of travel. Thus, the lights of an oncoming motorist will pick up the reflector device, and light be reflected back, some good distance away, whereby the motorist will be alerted to any change in the direction of the traffic lane, edge of the roadway, or the like. Quite advantageously, the reflector device disclosed herein will find good use on the on-and-off ramps on highly travelled highways and in the areas leading to and from these ramps. In this application, in particular, the reflector devices can be installed in rather close proximity to one another whereby to spell out various warning messages, e.g., "Stop", "Go Back, Off Ramp", etc.

In operation, when the rotatable reflector element 16 is impacted by the tire of a passing motor vehicle, it will be caused to rotate, in the event of a horizontally directed force, i.e., one in the direction of travel, whereby to dissipate the possible damaging effects of any such a force. And, when a vehicle tire passes over the reflector device, the force in the vertically downward direction will cause the supporting member 18 to be depressed downwardly against the coiled springs whereby to dissipate the damaging effects of this downwardly directed force. It will be appreciated that the length of the coiled springs should be such, as should the vertical distance between bottom surface 24 and top surface 66, that the supporting member 18 does not bottom out in the housing 14. Otherwise, the reflector device may be damaged, because of the resistance offered.

The coiled springs should, when the downwardly directed force becomes zero, i.e., the vehicle tire has passed over the reflector device, return the support member to its initial position. Otherwise, the reflector element 16 may be too low to be seen by an oncoming motorist. The vertical upward movement of the support member is stopped when outwardly extending surface 58 is contacted by the inwardly extending surface 30. These two surfaces are kept in contact with one another through the action of the coiled springs wanting to further expand. Quite advantageously, in the use of the reflector device disclosed herein, a snowplow blade impacts only that portion of the reflector projecting above the roadbed and the top surface 22 With such an impact, the reflector device 10 is readily caused to rotate, this rotation being facilitated somewhat by the rather unique toothed structure provided. Quite advantageously, where the horizontally directed force has a vertical component, that vertical component merely causes the reflector element to rotate, and where that force has a downward component, the support member is merely pushed vertically downwardly. Thus, the reflector device, according to this invention, gives way to any force directed at it from an oncoming motorist. As a result, the effects of such possible damaging forces are considerably lessened, if not reduced entirely.

Figure 5:
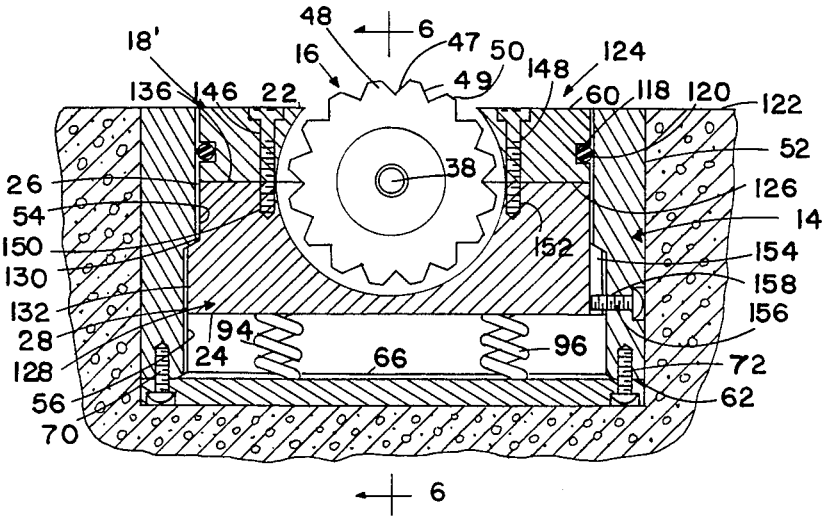
FIG. 5 is a view in cross-section similar to that in FIG. 1, showing the embodiment of a further reflector device, in accordance with the invention, taken at the same location as the cross-sectional shown in FIG. 3.
Figure 6:
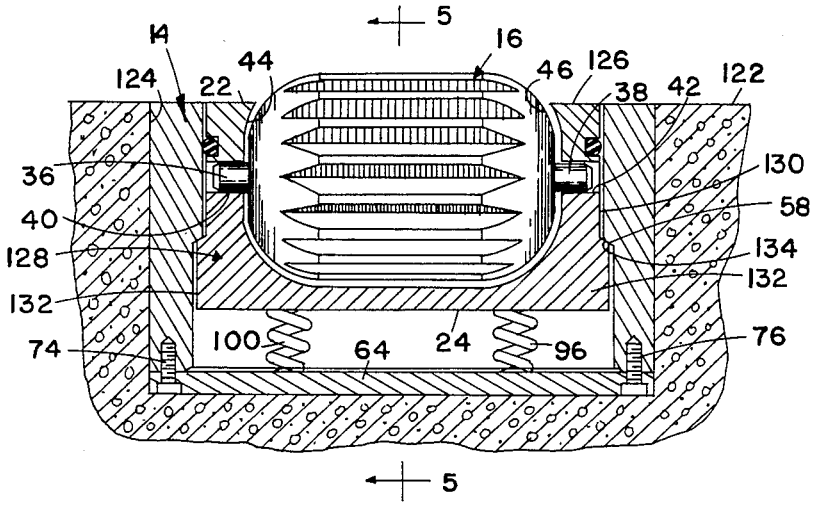
FIG. 6 is a sectional view of the reflector device shown in FIG. 5, in a transverse direction thereto.
Figure 7:
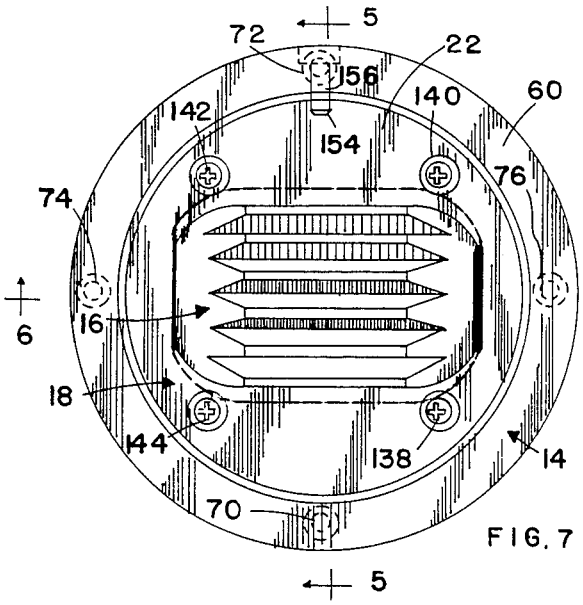
FIG. 7 is a top plan view of the reflector device shown in FIGS. 5, 6, showing the location of the threaded means for detachably connecting the top portion of the supporting member to the bottom portion thereof.

Turning now to FIG. 5 of the drawing, there is disclosed therein a somewhat modified support member for the elongated reflector element 16, referred to broadly by reference numeral 18'. The support member 18' comprises, as shown in FIGS. 5,6, an upper, horizontally disposed circular-shaped portion 124 defined by top surface 22 and planar, horizontally disposed bottom surface 126, parallel thereto, and a bottom portion 128. The bottom portion 128 is defined by an upper circular-shaped vertically disposed peripheral surface 130 and a lower, circular-shaped peripheral surface 132, of somewhat greater diameter, concentric therewith, these two peripheral surfaces being connected together by inwardly projecting surface 134, which performs the same function as surface 30, in FIG. 3, horizontally-disposed top surface 136, and bottom surface 24. Top circular-shaped surface 136 is in a plane parallel to bottom surface 24. The top portion 124 is detachably connected to bottom portion 128 by four elongated, threaded members 138,140,142, and 144 which extend vertically downwardly in top portion 124 through circular-shaped openings therein, only two of which openings 146,148 are shown in the drawing (FIG. 5). As will be seen by reference to FIG. 5, these threaded members are threaded into respective, threaded, dead bores, two of which are shown in the drawing, identified by reference numerals 150,152. The flat heads of the threaded members are, as shown in the drawing, in the same plane as the top surfaoe 22 in the support member 18. It will be appreciated that although four threaded members are shown in the drawing that a larger number can be used, if desired. Nevertheless, there should desirably be at least two threaded members provided. Quite advantageously, providing support member 18 in two detachable portions 124, 128 permits ready replacement of the reflector element 16, in the event that such needs replacement for any reason, e.g., a damaged reflector element, reflector teeth worn down, etc. With the embodiment of the invention shown in FIG. 3, the reflector element can only be replaced by extracting the entire device from the roadbed. A further advantage in this embodiment of the invention is that the elongated well can be provided of a shape that more readily conforms to the circular-shaped reflector element 16, as will be seen by reference to FIGS. 5,6. Thus, in cross-section, the well can be, in general, of circular shape, leaving only that clearance with teeth 48 necessary for the reflector element 16, to have freedom of rotation. Thus, no corners exist in the well for deposit and accumulation of road debris, e.g., particles of dust and dirt, or water. Any dirt that manages to get into well 20 will be essentially swept out by teeth 48 through rotation of the reflector element, leaving at most a thin layer thereof. And, any water accumulation will be only a thin film left untouched by the teeth. Quite advantageously, any resistance to rotation offered by such a thin film of water, in the event of freezing, can be readily overcome by any force directed at the rotatable member. Furthermore, as the well conforms more to the shape of the rotatable reflector element, the top opening can be made more narrow, and, in closer tolerance with that reflector element leaving less opportunity for dirt to get into the well, in the first place.

The well opening provided in top surface 22 can vary somewhat in width as desired, depending somewhat on the diameter of the reflector element and the location of its axis of rotation, vertically. The closer the axis of rotation to surface 2, the wider will need be the well, the widest opening being with some slight clearance equal to approximately the diameter of the reflector element, somewhat as shown in FIG. 3. Nevertheless, the opening should desirably be only wide enough, as shown in FIG. 5, to permit at most the top portion of the reflector element to project above the roadbed. In general, satisfactory results are provided when only the top most three teeth or so project above surface 24. The oncoming vehicle lights should, in general, be able to at least "see" the top most tooth, whereby to provide a suitable amount of reflection back to the motorist. The amount of reflection will depend to some extent, of course, upon the particular construction of the reflector element.

In the bottom portion 128, as will be seen in FIG. 5, there is provided a vertically disposed slot, or key-way 154, into which intrudes key 156, in this case an elongated threaded member, projecting inwardly, in horizontal direction, though housing 14 into threaded opening 158. Thus, support member 18 is provided stationary relative to housing 14 in horizontal direction. The support member 18, nevertheless, can move up and down in vertical direction, relative to housing 14, the limit thereof being determined by the surface 134 in an upward direction and by the coiled springs in a downward direction. It will be appreciated that slot 154 should not limit the downward direction of the support member, the extent of which should be determined by the coiled springs and the vertical distance from bottom surface 24 to the top surface 66 of the bottom member 64. Nevertheless, the key 156 should track the slot 154 the entire reciprocal movement of the support member. Although not shown in FIG. 3, it will be appreciated that such a key-way can be provided therein to prevent rotational movement of the support member relative to the housing, if desired. Other known means to accomplish the same result can also be used, instead, there being nothing critical in the particular construction of such a device.

Figure 9:
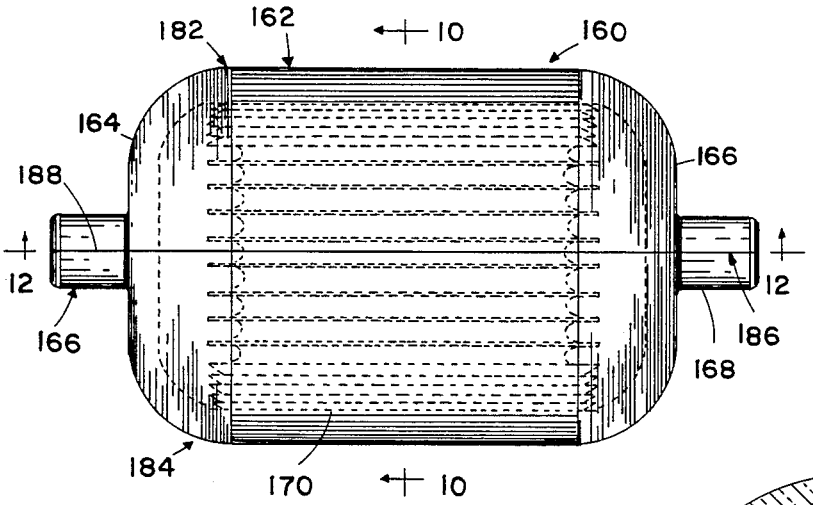
FIG. 9 is a side view showing another, and more preferred, embodiment of an elongated, cylindrical-shaped reflector element according to the invention.

Reference should now be made to FIG. 9 in which is disclosed a further embodiment of a rotatable reflector element in accordance with this invention, as denoted generally by reference numeral 160. The reflector element is of a generally cylindrical-shaped, elongated, horizontally disposed body member 162 having rounded ends 164 and 166 integral with and connected to the said body member and to centrally disposed, circular-shaped ends 166,168 which extend in opposition to one another and axially with respect to the cylindrical-shaped body member 162.

Figure 10:
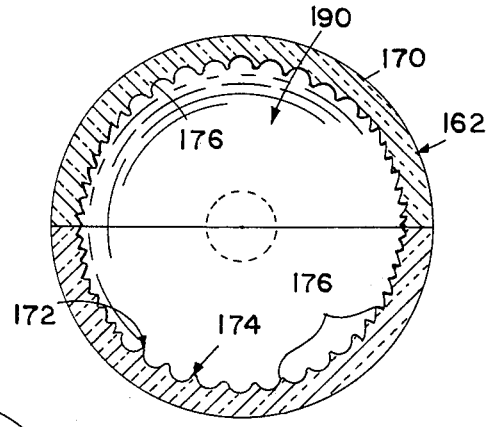
FIG. 10 is a view in cross-section, taken at secant lines 10—10, of the reflector element shown in FIG. 9, showing the reflective pattern provided, on the inside cylindrical-shaped surface.
Figure 11:
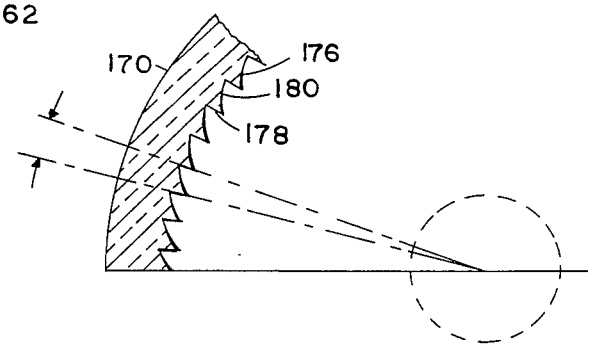
FIG. 11 is an enlarged view of a portion of the view shown in FIG. 10, better showing the cross-section of the reflective pattern.

In contrast to the reflector element 16, the outer, peripheral surface 170 of body member 162 is smooth, as readily seen by reference to FIG. 10. And, the inner peripheral surface 172 is provided with a reflective pattern 174, which, as shown, comprises a plurality of teeth 176 extending lengthwise of the body member 162 and spaced apart from one another around the circumference thereof. These teeth may take various shapes in cross-section, for example, saw-tooth, scalloped, with rounded, or sharp edges, or of the shape shown in FIG. 8. The reflective pattern, in any case, can comprise teeth of uniform shape and size, if desired, as shown in FIG. 11. Nevertheless, as shown in FIG. 10, a satisfactory reflective pattern can comprise a combination of teeth, each of a somewhat different size and cross-sectional shape.

Thus, the reflective pattern 174 can comprise a plurality of next adjacent teeth having a sawtooth pattern followed by a plurality of teeth of a scalloped characteristic and then back to the saw-tooth pattern. The teeth need not be of the same height and can vary from one height to another in a pattern around the inner peripheral surface. In the case of a sawtooth design, as disclosed in FIG. 11, each tooth 176 comprises a front side 178 and a back side 180 the first of which can coincide with a radius of the cylindrical-shaped body member and the latter at an acute angle thereto, and diverging outwardly from front side 178 toward the outer peripheral surface 170, a tooth height from about 1/64"–⅛" will be found satisfactory; however, the optimum height in any particular reflector pattern will depend upon the member of teeth and the shape of the teeth in the reflective pattern, whether the teeth are of uniform cross-section, and the particular cross-section involved. In the case of the reflective pattern 174 shown in FIG. 10, the scalloped appearing teeth can vary in height from about 150 "–1/16", and the sawtooth appearing teeth from 1/16"–1/64", and then the pattern repeated around the inner peripheral surface 172.

Figure 12:
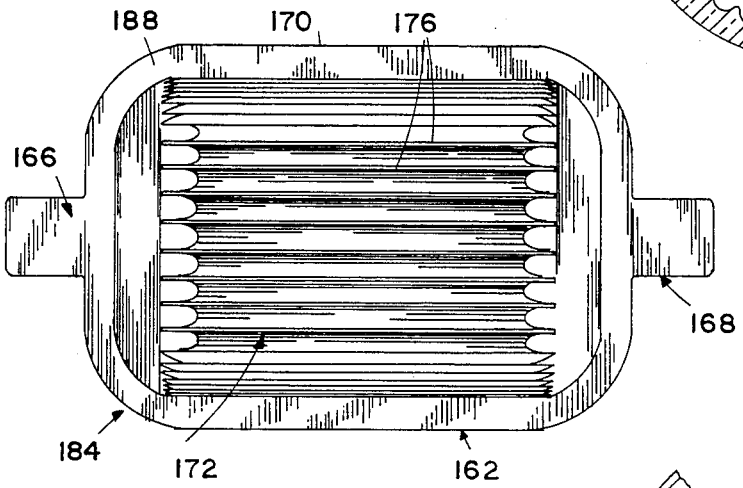
FIG. 12 is a top plan view of the bottom half of the reflector element shown in FIG. 9, better showing the reflective pattern provided on the inner, cylindrical-shaped surface.

Other reflective patterns known to those in the art may also be used, particularly those of the retroreflective type, if desired. For example, the reflective pattern can comprise a plurality of raised, regular shapes such as pyramids, etc., as conventionally provided in reflector patterns. The end surfaces can be without a reflective pattern, as is shown in FIGS. 9,12, or also provided with a pattern, as desired. That pattern can be a continuation of that provided on the inner peripheral surface 172, or a different reflective pattern. The main consideration with respect to this aspect of the invention is that the reflective pattern be provided on the inner peripheral surface and that the outer peripheral surface and that of the ends be made smooth, according to conventional techniques in manufacturing patterned reflectors.

The cylindrical-shaped reflector element 160, as will be appreciated by reference to FIGS. 9,10 of the drawings, comprises two equal parts 182,184, which are mirror images of one another. Thus, the manufacture of reflector element 160 can be readily accomplished, the two parts 182,184 thereof being manufactured by conventional molding techniques and then joined together at their planar mating surfaces 186,188. This can be accomplished by various known techniques, depending upon the particular plastic material comprising the reflector element, e.g., electronic welding, such as high-frequency heating, heat bonding, or adhesive bonding.

Various plastic compositions can be used in the manufacture of the reflector element 160, these conventionally being used in the manufacture of reflector patterns, including polyvinyl chloride, polyacrylates, nylon, polyvinyl acetal resins, polycarbonates, etc. These compositions can include various fillers, according to conventional techniques, as desired, depending upon the particular characteristics desired, e.g., hardness, resistance to abrasion, better frictional characteristics, resistance to wear, coloring agents, etc.. A primary consideration is that the plastic composition used provide a clear or transparent reflector element whereby the lights of the oncoming motorist can see the reflector pattern and be reflected back. The outer peripheral surface of the reflector element must be smooth and have a mirror-like finish thereto.

In some cases, the cylindrical-shaped cavity 190 will desirably be filled with a reflector composition which comprises particles of reflective material dispersed therein, e.g., reflective metal particles, such as aluminum. These particles may be provided in a clear plastic solid that occupies the entire cavity or be suspended in a gel-like material that is essentially a solid. In addition to the reflective particles, or instead of, particles of a suitable phosphor can be dispersed in the reflective composition.

Figure 14:
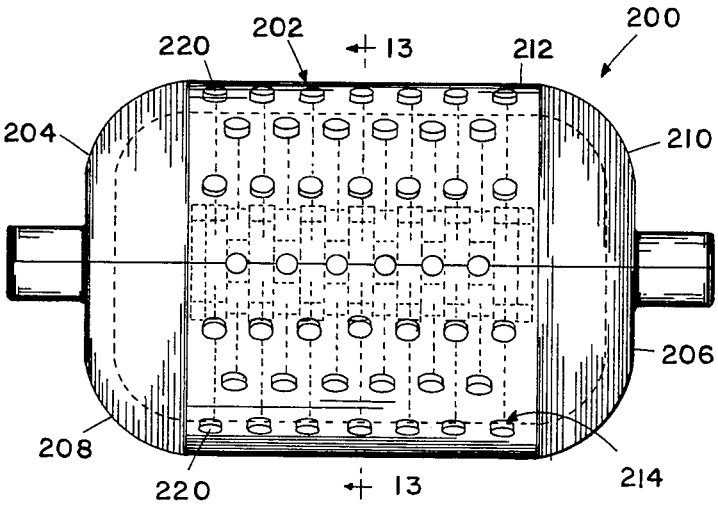
FIG. 14 is a side view of the reflector element shown in FIG. 13 showing the light collector-emitter points located at the outer surface of the reflector element.
Figure 13:
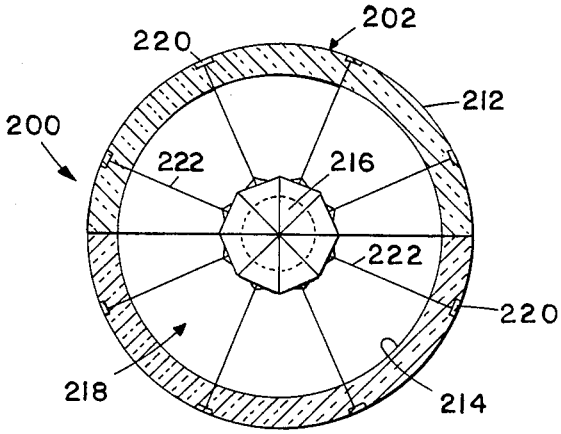
FIG. 13 is a view in cross-section of a further embodiment of a cylindrical-shaped reflector element, in accordance with another aspect of the invention, in which a solar collector is located centrally within the cavity inherent therein.

Turning now to FIGS. 13,14, there is disclosed therein still a further embodiment of a reflector element, according to the invention, identified generally by reference number 200. Reflector element 200, like that shown in FIG. 9, is of a cylindrical shape and comprises a centrally disposed, cylindrical shaped body member 202 defined at respective ends by vertically disposed circular-shaped ends 204,206, located centrally with respect to the axis of the reflector element. These ends are integral with the centrally disposed body member, at their outer peripheral limits which define rounded connecting surfaces 208,210, as shown, both at the external and internal peripheral surfaces 212,214 of the cylindrical-shaped body member 202. As shown in FIG. 13, the peripheral surfaces 212,214 are both smooth; however, if desired, a reflector pattern can be provided on the inner peripheral surface, as earlier disclosed. Critically, however, a solar cell or collector 216, e.g., a photoconductor, will be located centrally within cavity 218. Thus, the clear plastic reflector member will allow light, e.g. the sun's rays to be collected during the daylight hours and light then to be emitted at dusk, making the reflector element visible to the oncoming motorist. The working of the solar collector 216 can be improved somewhat by providing a plurality of satellite collectors 220 in the outer peripheral surface 212 of the reflector element. These satellite collectors can be connected to solar collector 216 through bundles of optical fibers 222. Thus, at night-time, the lights of the oncoming motorists will advantageously see the solarlike collectors 220 which, through the associated optical fiber bundle 222 will transfer the light seen to the solar collector 216, and light will then be transported back, via the optical fiber bundles 222 to the outer peripheral surface 212, to be seen by the oncoming motorist.

The support member for the reflector element, and the housing therefor can be made of various materials, and need not be of the same material as the reflector element. These components can be molded from suitable plastic compositions, or milled from a solid block thereof, if desired. They can also be of metal construction. Nevertheless, all components of the reflector device of this invention can readily be, and are preferably, molded from suitable plastic compositions, as earlier disclosed. This greatly simplifies and provides economy in the manufacture of the reflector device.

Other modifications and changes, as will be understood by those skilled in the art, can be made in the invention and its form and construction without departing form the spirit and scope thereof. The embodiments disclosed herein are merely exemplary of the various modifications that the invention can take and the preferred practice thereof. It is not, however, desired to confine the invention to the exact construction and configurations shown and described herein, but it is desired to include all such as properly come within the spirit and scope of the invention disclosed.

What I claim is:

1. A roadway reflector device suitable for marking the lanes in a roadway and which is to be embedded substantially below the grade of the roadway yet having a portion thereof projecting above the grade to be seen by oncoming motorists comprising:

(a) a reflector assembly capable of vertical up and down movement comprising:
  (1) an elongated, circular-shaped, horizontally disposed, rotatable reflector element;
  (2) a member for supporting said reflector element in a freely rotatable manner and in said horizontally disposed position comprising planar, parallel, horizontally disposed top and bottom surfaces defining the extremities of said supporting member vertically, and an elongated well in said top surface substantially surrounding and locating said elongated rotatable reflector element;

(b) a housing for reciprocally supporting the said reflector assembly in vertical up and down manner having an open top and being defined by a planar horizontally disposed bottom member having a top surface and a bottom surface; and (c). compressible means located between said bottom surface of the said supporting member for the reflector element and the said top surface of the bottom member of said housing for reciprocally supporting the said reflector assembly.

2. A roadway reflector device according to claim 1 wherein the elongated, circular-shaped, horizontally disposed, rotatable reflector element comprises an elongated, circular-shaped, horizontally disposed body member, a plurality of elongated teeth extending lengthwise of the said elongated body member and being spaced apart uniformly about its peripheral surface, each said tooth being defined by planar, elongated surfaces extending lengthwise and which slant outwardly from one another in a direction toward the circular-shaped body member.

3. A roadway reflector device according to claim 2 wherein a substantially flat, outer, elongated surface defines each said elongated tooth at its outer extreme, said substantially flat, outer, elongated surface being defined by a radius of the said circular-shaped, elongated body member.

4. A roadway reflector device according to claim 3 wherein the height of each tooth is approximately 0.170 inches measured inwardly on said tooth from said outer flat surface on a radius of the elongated body member bi-secting the tooth.

5. A roadway reflector device according to claim 4 wherein the plane formed by an elongated surface of one tooth intersects the plane formed by the elongated surface of the next adjacent tooth at a 90 degree angle.

6. A roadway reflector device according to claim 5 wherein the angle subtended by each tooth disposed about the circular-shaped body member is 22 ° 30′.

7. A roadway reflector device according to claim 2 wherein the elongated body member of the said reflector element is formed of a suitable plastic composition.

8. A roadway reflector device according to claim 7 wherein the said plastic composition comprises reflective material dispersed therein.

9. A roadway reflector device according to claim 8 wherein the said reflective materials comprise retro-reflective beads.

10. A roadway reflector device according to claim 8 wherein the reflective material comprises metallic particles.

11. A roadway reflector device according to claim 8 wherein the reflector material comprises a phosphor.

12. A roadway reflector device according to claim 11 wherein the phosphor comprises phosphorescent particles.

13. A roadway reflector device according the claim 7 wherein reflective material is provided on the lengthwise extending, elongated surfaces of each said tooth.

14. A roadway reflector device according to claim 13 wherein the reflective material comprises a phosphorescent material.

15. A roadway reflector device according to claim 14 wherein the phosphorescent material comprises an orange colored dye.

16. A roadway reflector device according to claim 2 wherein a circular-shaped opening is provided centrally of the circular-shaped body member and extends its entire length.

17. A roadway reflector device according to claim 16 wherein an elongated, circular-shaped axle is provided in said circular-shaped opening which extends equidistantly beyond the length of the circular-shaped body member, at both ends, and is supported at each end by said supporting member.

18. A roadway reflector device according to claim 1 wherein the said member supporting the reflector element is further defined by an elongated vertically disposed circular-shaped surface defining the outer periphery thereof, and an inwardly projecting groove is provided in said outer peripheral surface adjacent the said top surface of the supporting member.

19. A roadway reflector device according to claim 18 wherein the said housing for the reflector assembly comprises a vertically disposed, annular-shaped, upper body member defined by planar, horizontally disposed, parallel, annular-shaped top and bottom surfaces, and said body member is of circular shape, the said bottom surface of the annular-shaped body member being supported by, and resting on, the top surface of the said bottom member of the housing and being connected thereto.

20. A roadway reflector device according to claim 19 wherein a plurality of dead bores are provided in the bottom surface of the said supporting member for the reflector element and the top surface of the said bottom member of the housing, in opposition to one another, and said compressible means comprises a plurality of elongated, vertically disposed coiled springs, the one end of each of which is located in a dead bore in the bottom surface of the said supporting member and the other end of which is located in the opposing dead bore in the said bottom member.

21. A roadway reflector device according to claim 18 wherein the said annular-shaped upper body member is defined by an outer circular-shaped surface and an inner surface having an upper, circular-shaped surface, and a lower, circular-shaped surface of slightly larger diameter, and an outwardly extending surface connects together said outer and inner circular-shaped surface, and the said outer periphery of the said supporting member is defined by an upper peripheral, circular-shaped surface and a lower peripheral, circular-shaped surface of a somewhat larger diameter and an inwardly projecting surface connecting together the said upper and lower peripheral surfaces, the said peripheral surfaces of the support member being complementary to the said upper and lower, circular-shaped surfaces of the housing, whereby the said outwardly extending surface of the housing, in operation of the reflector device, is contacted by said inwardly projecting surface of the supporting member and provides a stop to any further vertical movement upwardly of the supporting member and whereby the top surface of the supporting member is in the same horizontal plane as the top, annular, horizontally disposed, surface of the upper body member of the housing.

22. A roadway reflector device according to claim 1 wherein the said reflector element supportihg member comprises an upper, horizontally disposed portion, and a bottom, horizontally disposed portion detachably connected thereto, a planar, horizontally disposed, bottom surface defining the bottom of said upper portion and a planar, horizontally disposed, top surface defining the top of said bottom portion, the said bottom surface being supported by and resting directly against the said top surface.

23. A roadway reflector device according to claim 1 wherein the member supporting the reflector element is further defined by an upwardly extending body member having a circular-shaped top portion and a circular-shaped bottom portion of a predetermined larger diameter, and said housing for the reflector assembly is further defined by an upwardly extending annular-shaped body member having a top, circular-shaped, inner surface and a bottom, circular-shaped, inner surface of a predetermined larger diameter, the said bottom circular-shaped inner surface of the housing being complementary to the said circular-shaped bottom portion of the said supporting member.

24. A roadway reflector device according to claim 23 wherein a vertically disposed, elongated keyway is provided in the peripheral surface of the supporting member, and an associated key is provided in said housing projecting inwardly from said inner surface thereof into said keyway whereby the key rides up and down in the keyway when the supporting member reciprocates up and down, and the supporting member is prevented from rotating in a horizontal direction relative to the housing.

25. A roadway reflector device according to claim 24 wherein a horizontally disposed threaded opening is provided in the housing in opposition to said key way and said key is a threaded member of appropriate length.

26. A roadway reflector device according to claim 1 wherein said housing is further defined by an upwardly extending annular-shaped body member having a top, planar surface and a bottom planar surface parallel thereto and said bottom member is detachably connected thereto..

27. A roadway reflector device according to claim 26 wherein a plurality of vertically disposed, threaded dead bores are provided in the bottom surface of the annular-shaped body member and a plurality of vertically disposed openings are provided in said bottom member, correspondingly located to said dead bores when the annular-shaped body member is in association with the bottom member, and a like plurality of threaded members are provided, located in said vertically disposed openings and extending into the said threaded dead bores whereby the bottom member is detachably connected to the upwardly extending body member.

28. A roadway reflector device according to claim 1 wherein the elongated, circular-shaped, rotatable reflector element is defined by a centrally disposed, cylindrical-shaped body member, and elongated circular-shaped ends of a lesser diameter extending from each end of the said centrally disposed body member, and in opposition to one another, the axis of said circular-shaped ends being concentric with the axis of the said body member whereby the said ends provide means for supporting said reflector element in said support member and serve as an axle therefor.

29. A roadway reflector device according to claim 28 wherein the said centrally disposed, cylindrical-shaped body member comprises an outer, circular-shaped surface and an inner, circular-shaped surface, and said body member comprises a clear plastic composition.

30. A roadway reflector device according to claim 29 wherein said outer surface is smooth and said inner surface comprises a reflective surface whereby the lights of oncoming cars are reflected therefrom making the reflector device visible to the oncoming motorists.

31. A roadway reflector device according to claim 29 wherein a solar collector is provided within the cavity formed by said cylindrical-shaped body member whereby light energy can be collected by the said collector during the day and given off at dusk before oncoming motorists turn on their lights whereby the reflector device will be visible to the oncoming motorists.

32. A roadway reflector device according to claim 29 wherein a reflective composition is contained in the cavity formed by said cylindrical-shaped body member.

33. A roadway reflector device according to claim 32 wherein said reflective composition comprises a phosphor.

34. A roadway reflector device suitable for marking the lanes in a roadway and which is to be embedded substantially below the grade of the roadway yet having a portion thereof projecting above the grade to be seen by oncoming motorists comprising:

(a) a reflector assembly capable of vertical up and down movement comprising:
  (1) an elongated, circular-shaped, horizontally disposed, rotatable reflector element;
  (2) a member for supporting said reflector element in a freely rotatable manner and in said horizontally disposed position which comprises an upper, horizontally disposed portion, and a bottom, horizontally disposed portion detachably connected thereto, a planar, horizontally disposed, bottom surface defining the bottom of said upper portion and a planar, horizontally disposed, top surface defining the top of said bottom portion, the said bottom surface being supported by and resting directly against the said top surface, said upper and bottom portions further being defined by horizontally disposed, planar top and bottom surfaces defining the extremities of the supporting member vertically, and an elongated well in the said top surface of the upper portion for location of said elongated rotatable reflector element;

(b) a housing for reciprocally supporting the said reflector assembly in vertical up and down manner having an open top and being defined by a planar horizontally disposed bottom member having a top surface and a bottom surface; and (c) compressible means located between said bottom surface of the said supporting member for the reflector element and the said top surface of the bottom member of said housing for reciprocally supporting the said reflector assembly.

35. A roadway reflector device according to claim 34 wherein the said elongated well for location of the reflector element is of circular shape, in cross-section, defined by a radius which is a predetermined distance greater than the radius of the elongated, circular-shaped body member of the reflector element whereby the said reflector element can rotate freely in the well, when the reflector element is impacted by a horizontally directed force.

36. A roadway reflector device according to claim 35 wherein the center of the elongated, circular-shaped well and that of the circular-shaped body member coincide and is located on an imaginary line located between where the top surface of the bottom portion of the support member and the bottom surface of the top portion contact one another whereby the circular-shaped elongated well is partly located in the said top portion and partly located in the said bottom portion of the support member and a predetermined portion of the circular-shaped reflector body member projects above the top surface of the supporting member.

37. A roadway reflector device according to claim 34 wherein a plurality of vertically disposed, threaded, dead bores are provided in the said top surface defining the top of the bottom portion of the said supporting member, a like plurality of vertically disposed openings are provided in said upper portion of teh support member and in opposition to said dead bores when the two said support portions are in operative association with one another, and a like plurality of elongated, threaded members are provided in said openings and extending into respective dead bores, whereby the said two portions of the support member are detachably connected together.

38. A roadway reflector device suitable for marking the lanes in a roadway and which is to be embedded substantially below the grade of the roadway yet having a portion thereof projecting above the grade to be seen by oncoming motorists comprising:

(a) a reflector assembly capable of vertical up and down movement comprising:
  (1) an elongated, circular-shaped, horizontally disposed, rotatable reflector element;
  (2) a member for supporting said reflector element in a freely rotatable manner and in said horizontally disposed position comprising planar, parallel, horizontally disposed top and bottom surfaces defining the extremities of said supporting member vertically, and an elongated well in said top surface for location of said elongated rotatable reflector element, the said reflector element being defined by a centrally disposed, cylindrical-shaped body member, and elongated circular-shaped ends of a lesser diameter extending from each end of the said centrally disposed body member, and in opposition to one another, the axis of said circular-shaped ends being concentric with the axis of the said body member whereby the said ends provide means for supporting said reflector element in said support member and serve as an axle therefor, said cylindrical-shaped body member being of a clear plastic composition and comprising an outer, circular-shaped, smooth surface and an inner, circular-shaped surface which comprises a reflective surface whereby the lights of oncoming cars are reflected therefrom making the reflector device visible to oncoming motorists;

(b) a housing for reciprocally supporting the said reflector assembly in vertical up and down manner having an open top and being defined by a planar horizontally disposed bottom member having a top surface and a bottom surface; and (c) compressible means located between said bottom surface of the said supporting member for the reflector element and the said top surface of the bottom member of said housing for reciprocally supporting the said reflector assembly.

39. A roadway reflector device according to claim 38 wherein the reflective surface comprises a predetermined pattern provided on the inner surface.

40. A roadway reflector device according to claim 39 wherein the said reflective pattern comprises a plurality of elongated, spaced apart teeth located in and disposed uniformly about said inner surface and extending lengthwise thereof.

41. A roadway reflector device according to claim 40 wherein each said tooth is defined by two elongated planar surfaces which slant outwardly toward one another toward said outer surface.

42. A roadway reflector device accordingto claim 41 wherein one said planar surface diverges from an imaginary radius extending through the tooth at a somewhat greater angle than the other.

43. A roadway reflector device suitable for marking the lanes in a roadway and which is to be embedded substantially below the grade of the roadway yet having a portion thereof projecting above the grade to be seen by oncoming motorists comprising:

(a) a reflector assembly capable of vertical up and down movement comprising:

(1) an elongated, circular-shaped, horizontally disposed, rotatable reflector element which comprises a centrally disposed, cylindrical-shaped body member of a clear plastic composition having an outer, circular-shaped surface and an inner, circular-shaped surface and defining an inner, circular-shaped, elongated cavity, a reflective composition in said cavity comprising a phosphor, and elongated circular-shaped ends of a lesser diameter extending from each end of the said centrally disposed body member, and in opposition to one another, the axis of said circular-shaped ends being concentric with the axis of the said body member whereby the said ends provide means for supporting said reflector element in said support member and serve as an axle therefor;

(2) a member for supporting said reflector element in a freely rotatable manner and in said horizontally disposed position comprising planar, parallel, horizontally disposed top and bottom surfaces defining the extremities of said supporting member vertically, and an elongated well in said top surface substantially surrounding and locating said elongated rotatable reflector element;

(b) a housing for reciprocally supporting the said reflector assembly in vertical up and down manner having an open top and being defined by a planar horizontally disposed bottom member having a top surface and a bottom surface; and (c) compressible means located between said bottom surface of the said supporting member for the reflector element and the said top surface of the bottom member of said housing for reciprocally supporting the said reflector assembly.

44. A roadway reflector device according to claim 43 wherein said reflective composition comprises a suitable fluid material and reflective particles are dispersed therein.

* * * * *

UNITED STATES PATENT AND TRADEMARK OFFICE

CERTIFICATE OF CORRECTION

PATENT NO. : 4,737,049

DATED : April 12, 1988

INVENTOR(S) : Edward J. Callahan

It is certified that error appears in the above-identified patent and that said Letters Patent is hereby corrected as shown below:

On the title page, the inventors name "Callhan" should read -Callahan-.

In column 6, line 40, reference numeral "1" should read -16-.

In column 9, line 44, a period should be inserted following reference numeral "22" and before the word "With".

In column 10, line 17, the word "surfaoe" should read -surface-.

In column 12, line 7, the dimension "150" should read -1/8-.

In claim 22, line 2, the word "supportihg" should read -supporting-.

In claim 37, line 6, the word "teh" should read -the-.

Signed and Sealed this

Twenty-seventh Day of September, 1988

*Attest:*

DONALD J. QUIGG

*Attesting Officer*

*Commissioner of Patents and Trademarks*